US005456433A

United States Patent [19]

Burns et al.

[11] Patent Number: 5,456,433

[45] Date of Patent: Oct. 10, 1995

[54] ANTENNA ROOF MOUNTING

[76] Inventors: James M. Burns, 7055 E. 300 N., Brownsburg, Ind. 46112; Bruce K. Burns, 10314 Stormhaven Way, Indianapolis, Ind. 46256

[21] Appl. No.: 177,590

[22] Filed: Jan. 5, 1994

[51] Int. Cl.[6] ..... A47G 23/02

[52] U.S. Cl. ..... 248/148; 52/27; 248/237

[58] Field of Search ..... 248/148, 237; 343/878, 880, 888, 892; 52/27, 40, 219, 218, 198

[56] References Cited

U.S. PATENT DOCUMENTS

| | | | |
|---|---|---|---|
| 1,883,508 | 10/1932 | Bonday . | |
| 2,439,063 | 4/1948 | Shur | 248/237 |
| 2,575,254 | 11/1951 | Blaugrund . | |
| 2,628,796 | 2/1953 | Krizman . | |
| 2,731,225 | 1/1956 | Cayo . | |
| 2,891,748 | 6/1959 | Winegard . | |
| 3,409,256 | 11/1968 | Burns . | |
| 3,452,956 | 7/1969 | Reed . | |
| 3,618,883 | 11/1971 | Cohn . | |
| 3,656,170 | 4/1972 | Smith . | |
| 4,160,347 | 7/1979 | Logsdon | 52/218 X |
| 4,725,128 | 2/1988 | Gasque, Jr. . | |
| 4,799,642 | 1/1989 | Wright . | |
| 5,010,700 | 4/1991 | Blair | 52/219 X |

*Primary Examiner*—Ramon O. Ramirez
*Attorney, Agent, or Firm*—Clifford W. Browning; Woodard, Emhardt, Naughton, Moriarty & McNett

[57] ABSTRACT

An antenna roof mounting, comprising a substantially solid planar foundation that may be secured to a roof substrate; a substantially closed geometric superstructure affixed to and vertically raised upon the foundation; and a mast for an antenna affixed to the superstructure.

6 Claims, 6 Drawing Sheets

ANTENNA ROOF MOUNTING

BACKGROUND OF THE INVENTION

The present invention relates generally to devices for mounting antennae and like structures above a roof surface.

There are many and varied devices known in the prior art for mounting antennae and like structures above a roof surface. Most of the prior art devices are for designed for mounting either large elongated aerials or large dish-type antennae above a roof surface. Consequently, the prior art mounting structures have been bulky and complicated, and most require special installation materials and techniques to ensure that the roofs above which they are mounted do not leak. Despite the number and variety of the antenna mounting devices of the prior art, most share at least two characteristics: they are not pleasing to the eye, and they are awkward to install.

Whereas in the past it has been necessary to use the large bulky mounting devices to support the large antennae of the prior art, modern antennae of all kinds have decreased in size by comparison. Today, relatively small antennae may be used just as effectively as the larger, more bulky antennae of the prior art.

SUMMARY OF THE INVENTION

The ideal antenna roof mounting must be able to support an antenna and to maintain a stable platform in diverse weather conditions, such as snow, rain, wind and hail. The roof mounting must also allow an antenna to be pointed in both a lateral and a horizontal direction, but once properly positioned, the antenna must have very little lateral or horizontal movement. These requirements are magnified when a dish-type antenna is to receive signals from a satellite in a geocentric position. The ideal roof mounting must also be easy to install, and the installation and operation of the mounting must not cause damage to the roof surface. Since the best location for an antenna roof mounting cannot be predetermined, the ideal mounting must also be capable of being installed on a variety of roof surfaces of varying slopes.

The antenna roof mounting of the present invention satisfies the foregoing criteria for an ideal antenna roof mounting with a more esthetically pleasing design than known prior art devices. The antenna roof mounting of the present invention provides a prefabricated, sturdy base for mounting adjustable antennae and like structures that are most appropriately mounted on roof surfaces, installs easily upon a variety of sloped roof surfaces, and minimizes the possibility of roof leaks. A substantially closed geometric superstructure to support an antenna or like structure is joined to a planar foundation that is to overlie an existing roof substrate. Together they form a single unit that is more easily installed than known prior art antenna roof mountings. One edge of the planar foundation may serve as a flashing to be slid underneath an existing row of roof shingles to further minimize leaks following installation of the antenna roof mounting of the present invention. The substantially closed geometric shape of the superstructure has, in testing completed to date, withstood strong winds with very little flex even when constructed from relatively light material.

One embodiment of the present is an antenna roof mounting comprising a substantially solid planar foundation, having means to secure the foundation to a substrate; a substantially closed pyramidal superstructure affixed to and vertically raised upon the foundation; and means to mount an antenna affixed to the superstructure Another embodiment of the present is a substantially planar foundation, having means to secure the foundation to a substrate; a substantially closed coned superstructure affixed to and vertically raised upon the foundation; and means to mount an antenna affixed to the superstructure.

A principal object of the present invention has been to provide a more esthetically pleasing antenna roof mounting.

Related objects and advantages of the present invention will be evident from the following discussion.

DESCRIPTION OF THE PREFERRED EMBODIMENTS

Figure 1:
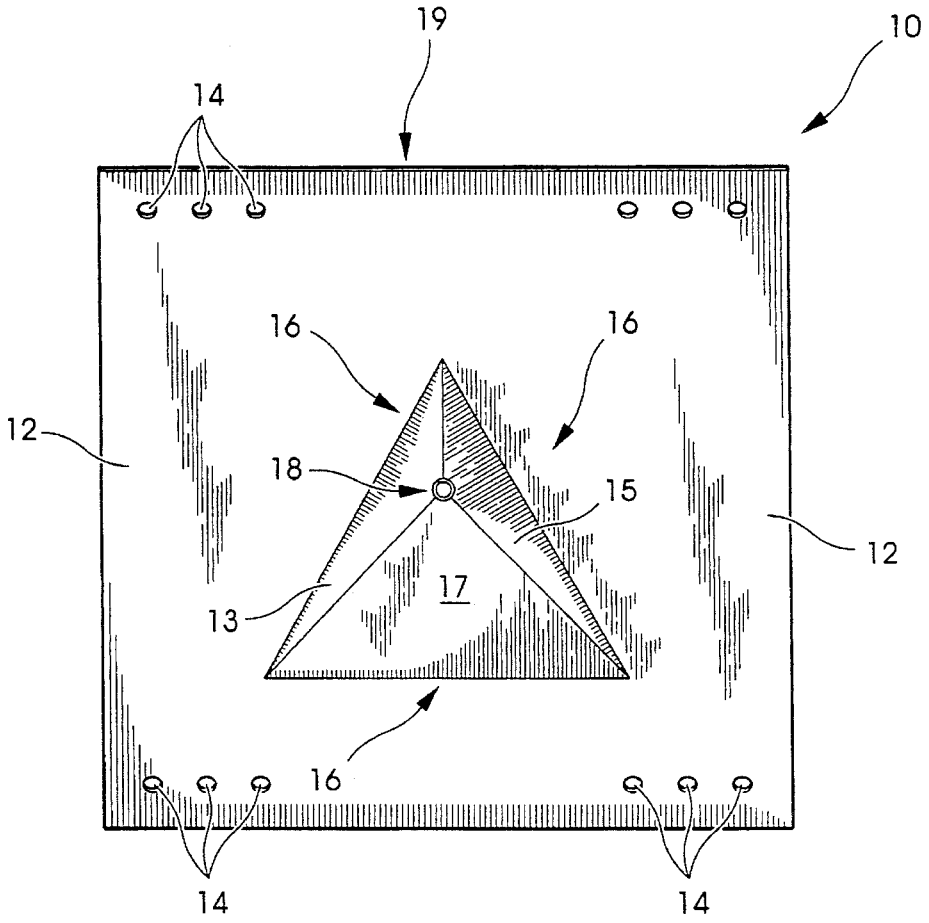
FIG. 1 a top view of a preferred embodiment of the antenna roof mounting of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications the illustrated devices, and such further applications of principles of the invention as illustrated therein being contemplated as would normally occur to one skilled in the art to which the invention relates.

Figure 2:
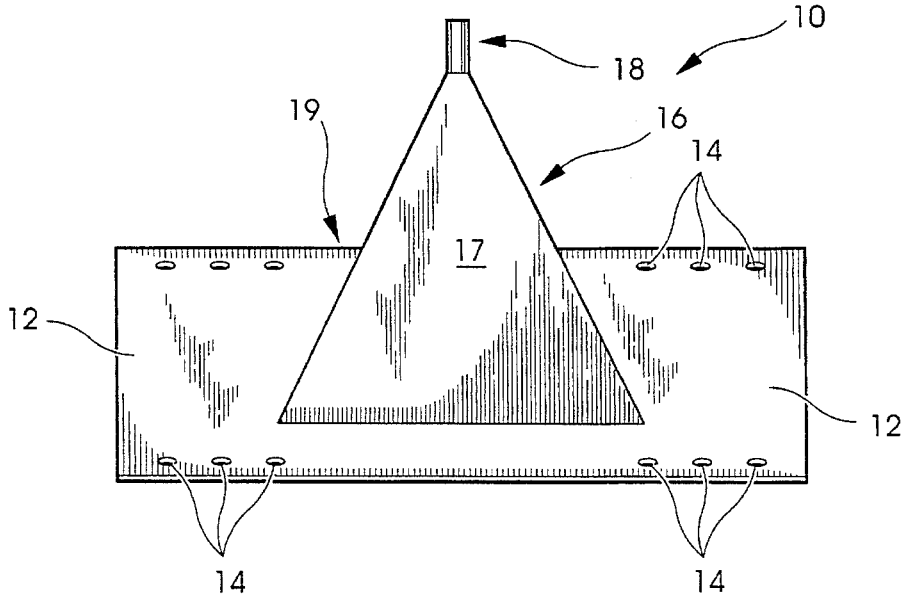
FIG. 2 is a front view of the antenna roof mounting of FIG. 1.
Figure 3:
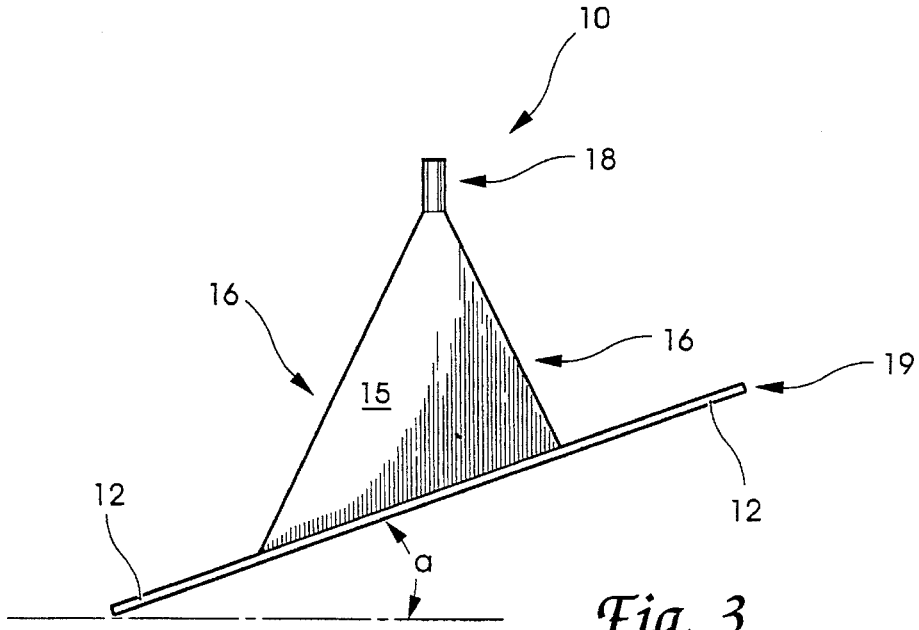
FIG. 3 is a right side view of the antenna roof mounting of FIG. 1.

Referring now to the drawings, illustrated in FIGS. 1 through 9 are several of the preferred embodiments to date of the antenna roof mounting of the present invention. Referring, first, to FIGS. 1 through 3, the most preferred embodiment to date 10 comprises a substantially solid planar foundation 12, having means 14 by which the foundation 12 may be secured to a roof substrate, a substantially closed three-sided pyramidal superstructure 16 affixed to and vertically raised upon the foundation 12, and means 18 to mount an antenna affixed to the superstructure 16.

In FIGS. 1 through 3, foundation 12 of the most preferred embodiment 10 is illustrated at a slope "a" (FIG. 3), which corresponds approximately to the standard slope found in many residential roofs. Foundation 12 is wide enough to bridge residential roof rafter supports whether they be on 16", 20" or 24" centers. In the preferred embodiment to date 10, the means to secure the foundation 12 to a substrate includes through holes 14 provided in the foundation 12 such that at least four through holes 14 will overlie roof rafter supports whether they be on 16", 20" or 24" centers. Self-sealing bolts (such as leg screws, not shown), or the like, may then be driven through the through holes 14 that overlay roof rafter supports, through the outer roofing material, and into the roof rafter supports to secure the foundation 12 to the roof substrate.

A substantially closed three-sided pyramidal superstructure 16 affixed to and vertically raised upon the foundation 12 of the most preferred embodiment 10. Referring to FIG. 3, superstructure 16 is vertically raised (with respect to the horizon) froth the foundation 12 when foundation 12 is disposed at a slope "a", with the result that two of the three triangular faces 13, 15 of superstructure 16 have substantially the same surface areas and the third triangular face 17 has a surface area larger than the surface areas of the other two triangular faces 13, 15.

Superstructure 16 may be either joined with a weather-tight seal to foundation 12 where the foundation 12 and the superstructure 16 intersect, or foundation 12 and superstructure 16 may by integrally formed as a single unit, such as by plastic injection molding, for example. Whether joined together or formed as an integral unit, that portion of foundation 12 that would underlie the superstructure 16 may removed or left open to provide access to the interior portion of the superstructure 16.

Affixed to the superstructure 16 is a means 18 to mount an antenna to the superstructure 16. As illustrated in FIGS. 1 through 3, means 18 is an antenna mast affixed to the vertex of the three-sided pyramidal superstructure 16 of the most preferred embodiment 10 to date. Equally preferred would be an antenna mast affixed to the superstructure 16 in any way that would provide a stable platform for the mounting of an antenna upon the superstructure 16 (see FIG. 9, for example, and the discussion infra).

Figure 4:
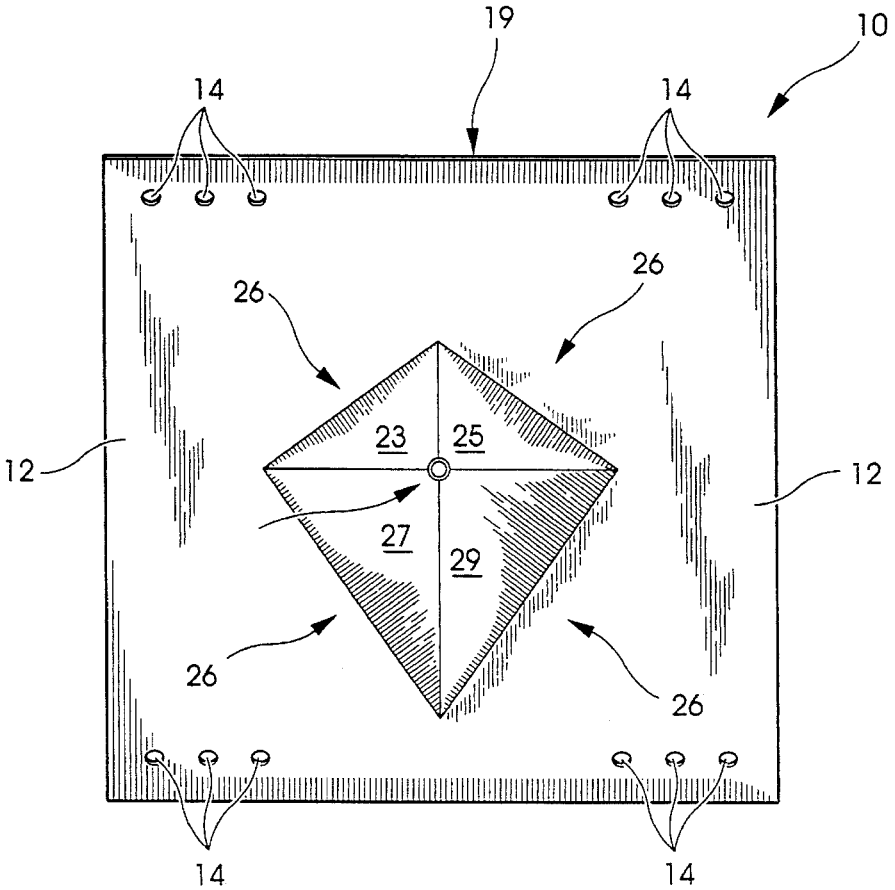
FIG. 4 is a top view of another preferred embodiment of the antenna roof mounting of the present invention.
Figure 5:
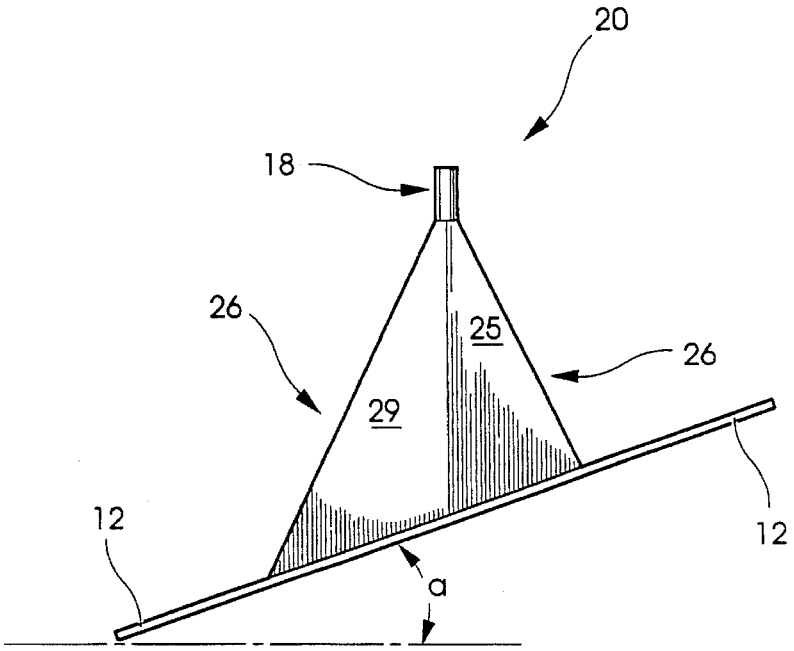
FIG. 5 is a right side view of the antenna roof mounting of FIG. 4.

Other preferred superstructures 26 and 36 of other preferred embodiments to date 20, 30 are illustrated in FIGS. 4 through 7. In FIGS. 4 and 5 the superstructure 26 is a substantially closed four-sided pyramidal superstructure 26 affixed to and vertically raised upon the same foundation 12 of the most preferred embodiment 10. Referring to FIG. 5, superstructure 26 is vertically raised (with respect to the horizon) from the foundation 12 when foundation 12 is disposed at a slope "a", with the result that two of said four triangular faces 23, 25 that share a common side have substantially the same surface areas, and the remaining two triangular faces 27, 29 that share a common side also have substantially the same surface areas which are larger than the surface areas of the other two sides 23, 25. Superstructure 26 may also be either joined with a weather-tight seal to foundation 12 where the foundation 12 and the superstructure 26 intersect, or foundation 12 and superstructure 26 may by integrally formed as a single unit. Whether joined together or formed as an integral unit, that portion of foundation 12 that would underlie the superstructure 26 may also be removed or left open to provide access to the interior portion of the superstructure 26.

Affixed to the superstructure 26 is a means 18 to mount an antenna to the superstructure 26. As illustrated in FIGS. 4 and 5, means 18 is again an antenna mast affixed to the vertex of the superstructure 26.

Figure 6:
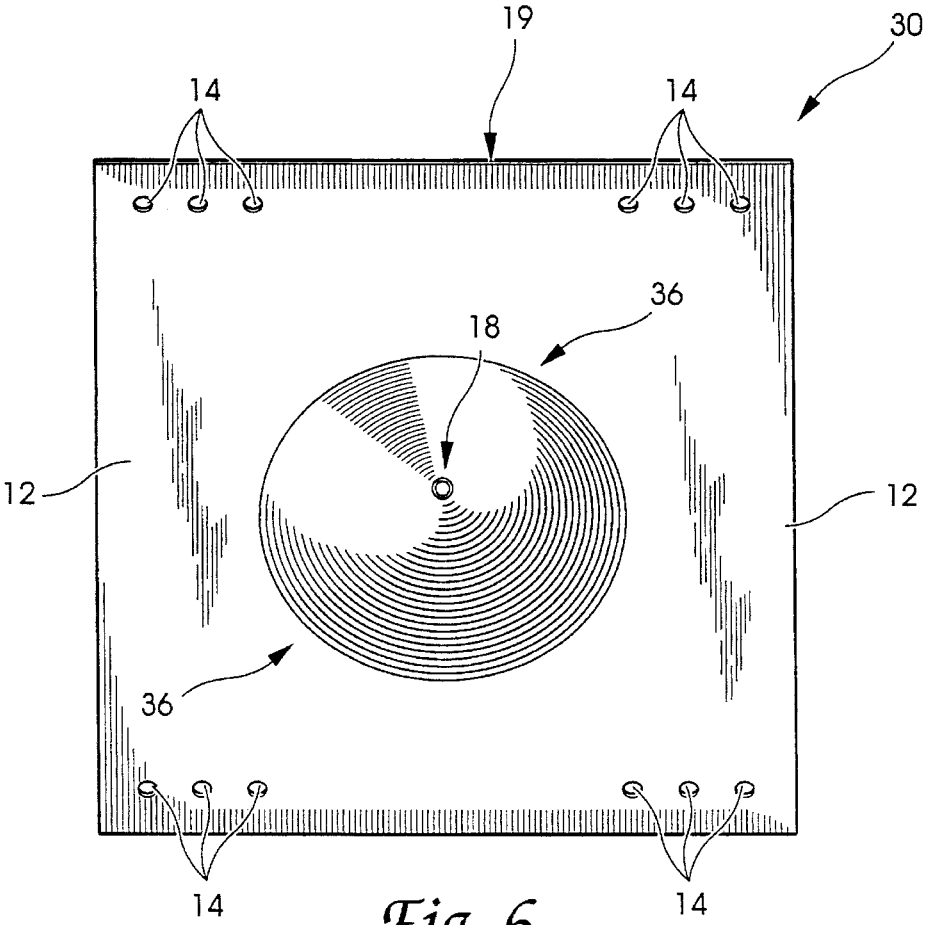
FIG. 6 is a top view of another preferred embodiment of the antenna roof mounting of the present invention.
Figure 7:
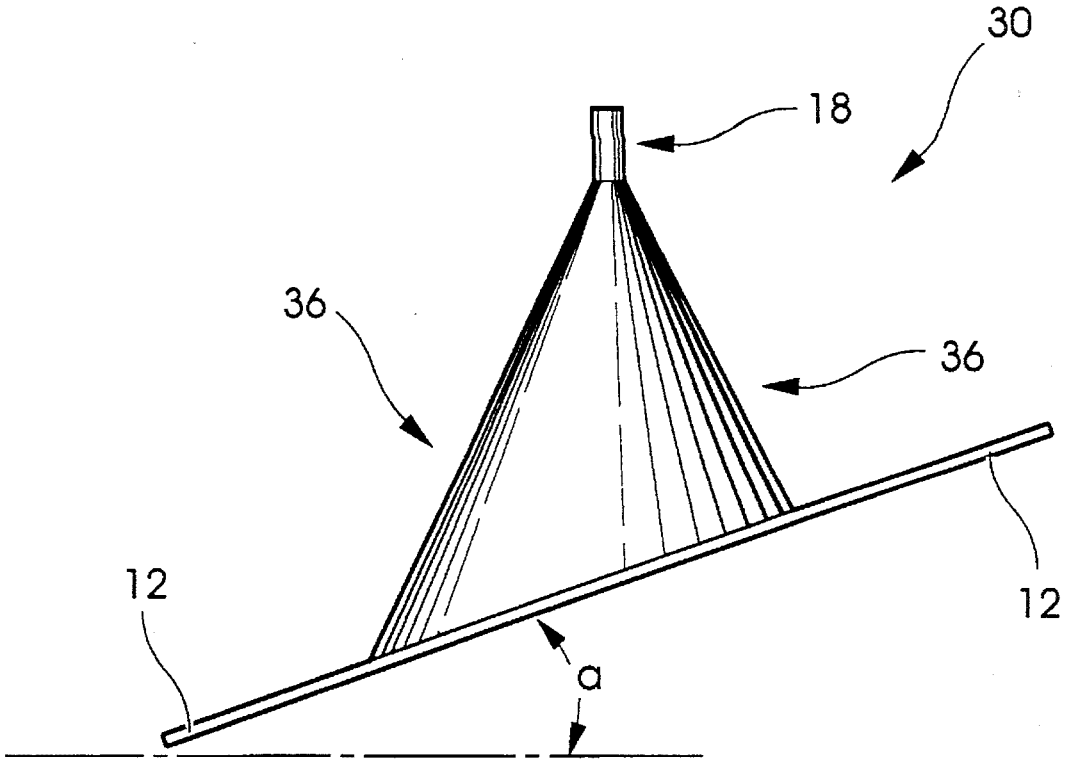
FIG. 7 is a right side view of the antenna roof mounting of FIG. 6.

In FIGS. 6 and 7 the superstructure 36 is a substantially closed coned superstructure 26 affixed to and vertically raised upon the same foundation 12 of the most preferred embodiment 10. Referring to FIG. 7, superstructure 36 is vertically raised (with respect to the horizon) from the foundation 12 when foundation 12 is disposed at a slope "a". Superstructure 36 may also be either joined with a weather-tight seal to foundation 12 where the foundation 12 and the superstructure 36 intersect, or foundation 12 and superstructure 36 may by integrally formed as a single unit. Whether joined together or formed as an integral unit, that portion of foundation 12 that would underlie the superstructure 36 may also be removed or left open to provide access to the interior portion of the superstructure 36.

Affixed to the superstructure 36 is a means 18 to mount an antenna to the superstructure 36. As illustrated in FIGS. 6 and 7, means 18 is again an antenna mast affixed to the vertex of the coned superstructure 36.

Figure 9:
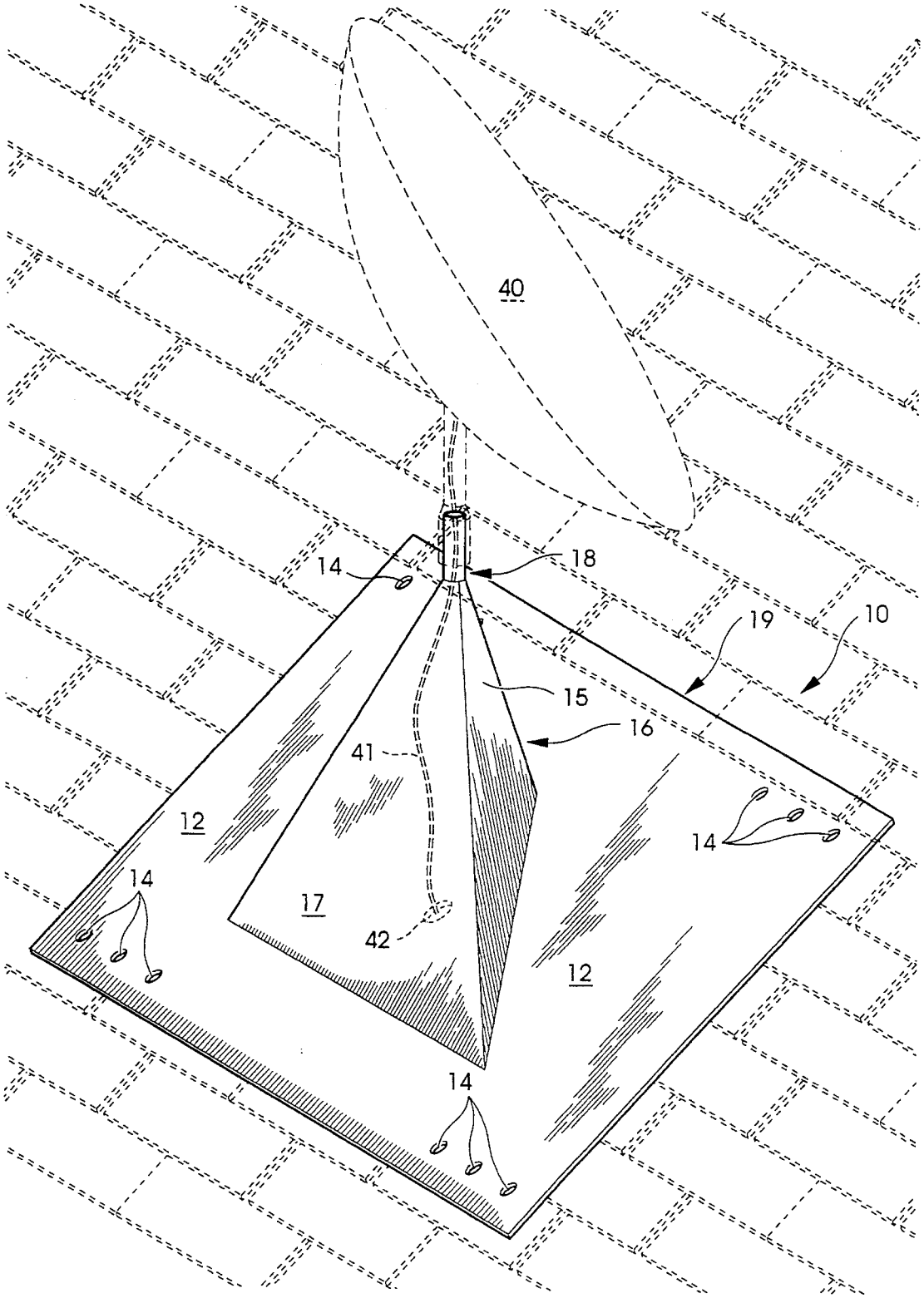
FIG. 9 is a perspective view of the antenna roof mounting of FIG, 1 a mounting position upon a sloped shingled roof shown in phantom lines with a dish antenna in phantom lines mounted thereon.

Referring now to FIG. 9, there is illustrated a preferred installation of the most preferred embodiment 10 of the antenna roof mounting of the present invention. Foundation 12 is overlayed upon a layered shingled roof illustrated in phantom in FIG. 9, having a slope of approximately "a", so that a point of the base of the closed three-sided pyramid superstructure 16 is pointing up the slope of the roof substrate. At least four through holes 14 are then located over the underlying roof rafter supports. The edge 19 of the foundation 12 furthest up the roof slope may then be slid under a row of shingles (as illustrated in phantom in FIG. 9) to prevent the capillary effect of water from seeping under the existing layered roofing material, edge 19 being sufficiently thin to be treated as flashing when the roof is of layered construction. Self-sealing bolts, or the like, may then be driven through the trough holes 14 overlying the roof rafter supports, through the roofing shingles, and into the rafter supports until the heads of the self-sealing bolts are flush with the foundation 12. The heads of the self-sealing bolls may then be weather sealed in any conventional manner.

An antenna 40, illustrated in phantom in FIG. 9 may then be mounted by conventional adjustable means on the means 18 to mount an antenna to the superstructure thereby providing adjustability in the positioning of antenna 40 atop the superstructure 16. An antenna wire may then be led to the antenna from under the roof line through a previously drilled hole 42 in the roof substrate underlying the superstructure 16 to protect it from leakage, as illustrated in FIG. 9, and through the antenna mast 18 to the antenna. Alternatively, an antenna wire may be led to the antenna 40 by overlaying wire upon the roof substrate (not shown). Any number of paths for the antenna wire may be selected.

Figure 8:
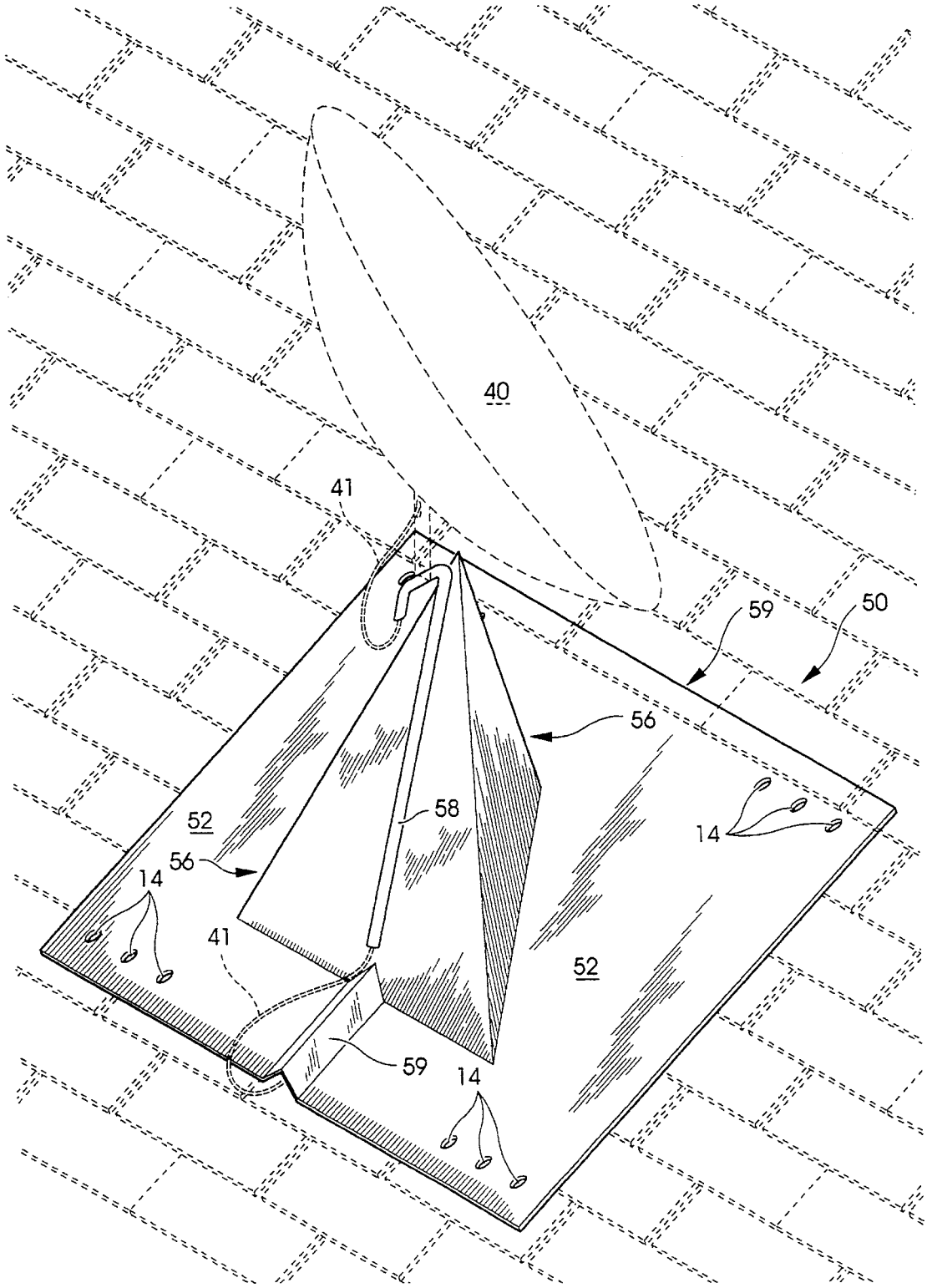
FIG. 8 is a perspective view of another preferred embodiment of the antenna roof mounting of the present invention in a mounting position upon a sloped shingled roof shown in phantom lines with a dish antenna in phantom lines mounted on one of the preferred antenna masts of the present invention.

Referring now to FIG. 8, there is illustrated another preferred installation of yet another preferred embodiment 50 of the antenna roof mounting of the present invention. In most respects, embodiment 50 is identical with the most preferred embodiment 10, with the notable exceptions being in the means 58 to mount an antenna to the superstructure 56 and the method and alternative structure by which an antenna wire 41 is led to the antenna 40.

Foundation 52 is overlayed upon a shingled roof illustrated in phantom in FIG. 8, having a slope of approximately "a", so that a point of the base of the closed three-sided pyramid superstructure 56 is pointing up the slope of the roof substrate. At least four through holes 14 are then located over the underlying roof rafter supports. The edge 59 of the foundation 52 furthest up the roof slope is then slid under a row of shingles (as illustrated in phantom in FIG. 8), edge 59 being sufficiently thin to be treated as flashing. Lag bolts, or the like, may then be driven through the trough holes 14 overlying the roof rafter supports, through the roofing shingles, and into the rafter supports until the leads of the self-sealing bolts are flush with the foundation 52. The heads of the self-sealing bolts may then be weather sealed in any conventional manner.

An antenna 40, illustrated in phantom in FIG. 8 may then be mounted by conventional adjustable means on the means to mount an antenna to the superstructure, which in this embodiment is an antenna mast 58 that is externally mounted to the superstructure 56 by conventional means, thereby providing adjustability in the positioning of antenna 40 atop the antenna mast 58. An antenna wire 41 may then be led to the antenna from under the roof line through a previously drilled hole in the roof substrate underlying the superstructure 56, as was the case in the embodiment illustrated in FIG. 9. The antenna wire would then be led through an inverted channel 59 formed in the foundation 52, and up through the antenna mast 58, exiling the antenna mast near the antenna 40. Alternatively, an antenna wire may be led to the antenna 40 by overlaying the wire the roof substrate (again not shown).

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An antenna roof mounting, comprising:

a substantially solid planar foundation, having means to secure the foundation to a substrate;

a substantially closed pyramidal superstructure secured to the foundation in a manner such that the superstructure is secured flush with the foundation, forming an enclosed space; and means to mount an antenna affixed to the superstructure.

2. The antenna roof mounting of claim 1, wherein said superstructure is a pyramid having three triangular faces.

3. The antenna roof mounting of claim 2, wherein two of said three triangular faces have substantially the same surface areas and the third triangular face has a surface area larger than the surface areas of the other two triangular faces.

4. The antenna roof mounting of claim 1, wherein said superstructure is a pyramid having four triangular faces.

5. The antenna roof mounting of claim 4, wherein two of said four triangular faces that share a common side have substantially the same surface areas and the remaining two triangular faces that share a common side also have substantially the same surface areas which are larger than the surface areas of the other two sides.

6. An antenna roof mounting, comprising:

a substantially planar foundation, having means to secure the foundation to a substrate;

a substantially closed coned superstructure secured to the foundation in a manner such that the superstructure is secured flush with the foundation, forming an enclosed space; and means to mount an antenna affixed to the superstructure.

* * * * *